United States Patent [19]

Fanti

[11] 4,397,053

[45] Aug. 9, 1983

[54] FOAM MATERIAL BODY FOR A MATTRESS, AND ELEMENT OF FURNITURE PROVIDED WITH SAME

[75] Inventor: Hansruedi Fanti, Flüh, Switzerland

[73] Assignee: Matra AG, Flüh, Switzerland

[21] Appl. No.: 188,595

[22] Filed: Sep. 19, 1980

[30] Foreign Application Priority Data

Sep. 20, 1979 [CH] Switzerland ..... 8481/79

[51] Int. Cl.[3] ..... A47C 27/15

[52] U.S. Cl. ..... 5/481; 5/468

[58] Field of Search ..... 5/481, 468, 448; 297/DIG. 1

[56] References Cited

U.S. PATENT DOCUMENTS

| | | | |
|---|---|---|---|
| 2,763,013 | 9/1956 | Valkenburgh | 5/481 |
| 3,538,521 | 11/1970 | Basner | 5/462 |
| 3,885,257 | 5/1975 | Rogers | 5/481 |
| 4,070,719 | 1/1978 | Murgan | 5/468 |
| 4,229,847 | 10/1980 | Degen | 5/481 |

FOREIGN PATENT DOCUMENTS

| | | |
|---|---|---|
| 839852 | 7/1976 | Belgium . |
| 1727445 | 8/1956 | Fed. Rep. of Germany . |
| 2856758 | 7/1980 | Fed. Rep. of Germany . |
| 571845 | 1/1976 | Switzerland . |

*Primary Examiner*—Alexander Grosz
*Attorney, Agent, or Firm*—Michael J. Striker

[57] ABSTRACT

A foam material body for a mattress has a core member having two supporting surfaces and provided with a plurality of recesses in each of said surfaces, wherein each of the recesses has an initial recess portion which is open at a respective one of the supporting surfaces, two deeper recess portions extending from the initial portion inwardly from the same and away from one another, and two narrow recess portions each connecting the initial recess portion with a respective one of the deeper recess portions. Each of the recesses has a depth which is smaller than half the thickness of the core member.

21 Claims, 2 Drawing Figures

FOAM MATERIAL BODY FOR A MATTRESS, AND ELEMENT OF FURNITURE PROVIDED WITH SAME

BACKGROUND OF THE INVENTION

The present invention relates to a foam material body for a mattress, and an element of furniture provided with the same.

Prior to the description of the present invention, it is believed to be advisable to define some terms which will be utilized hereinafter. In the field to which the present invention pertains, the terms "lower mattress" and "upper mattress" are frequently utilized. In an element of furniture utilized for lying and provided with spring transverse battens (which is called in Switzerland "lattlicouch"), the lower mattress is formed by a batten grate. when the term "mattress" is mentioned in the following description and claims, it is utilized to identify the upper mattress.

It is known to provide foam material bodies for mattresses with throughgoing openings and passages which extend transverse to the direction of elongation of the mattress, so as to influence the deformability and to provide ventilation of the mattress. One of such mattresses is disclosed for example in the German Offenlegungsschrift No. 2,841,870, which is the equivalent of U.S. Pat. No. 4,229,847, in which the foam material body is provided with a row of throughgoing openings extending transverse to the direction of elongation of the mattress. These throughgoing openings have an approximately lens-shaped cross-section whose larger portion is located in the horizontal central plane of the mattress, extends in the longitudinal direction of the mattress and is greater than the entire height of the foam material body. The maximum height of the throughgoing openings amounts to approximately two-thirds of the entire height of the foam material body. In the known foam material body, the center of the throughgoing openings and the greater dimension of the cross-section are located in the central plane of the foam material body. When the mattress bends along a vertical plane extending in its longitudinal direction, the neutral fiber of this bending is located in the above-mentioned central plane. The term "neutral fiber" is utilized here to define a fiber layer in which the material of the mattress neither stretches nor compresses during bending of the mattress. The throughgoing openings are located in the region of the neutral fiber and in the neighboring region. Thereby, no space is available in the upper and lower supporting faces of the foam material body, wherein the maximum elongation and shortening take place during the bending. The throughgoing openings increase the flexibility of the mattress only to a small extent. Since the throughgoing openings generally increase the flexibility only to a small extent, they must have relatively great cross-sectional dimensions. However, the throughgoing openings with such great cross-sectional dimensions have the disadvantage in the fact that during loading of the foam material body the latter has a tendency to assume a wave-like shape on the upper loaded side.

Another mattress is also known in which the foam material body is provided with recesses in its upper and lower supporting faces. Each recess in the upper supporting surface is arranged between two recesses provided in the lower supporting surface, and vice versa. Each recess has a mouth portion which is narrow and extends from the lower or upper supporting face normal to the latter, and an enlarged portion connected with the mouth portion at a certain depth. The enlarged portion is located approximately in the region of the central plane between the upper and lower supporting surfaces of the foam material body. When this mattress bends along a vertical plane extending in its longitudinal direction, the enlarged portions of the recesses are located in the vicinity of the neutral fiber, so that this increases the flexibility only to a small extent. The mouth portions of the recesses have practically no intermediate space available when the mattress assumes its horizontal unbent position. Thereby, the foam material body offers a relatively great resistance to bending, particularly in the region of that supporting face which dips during the bending.

A further known mattress has a three-layer foam material body. The outer layers are formed by compact plates without throughgoing openings or recesses. A core which is formed by the central layer is provided at its upper and lower supporting face with passages formed as recesses. These recesses which extend transverse to the direction of elongation of the mattress have a profile which is formed as a triangle with identical sides whose base line is straight and lies in the supporting face of the core and whose side lines form concave arcs. The recesses have, in their portions abutting against the outer layers, a relatively great width measured in direction of elongation of the mattress. Since the core is constituted of a harder foam material than the outer layers, the foam material body during loading by a person has a tendency to be considerably compressed in the region of the recesses, which is very disadvantageous.

The German Gebrauchsmuster No. 1,727,445 describes a three-layer mattress provided with upper and lower compact foam material plates and a foam material body therebetween, wherein the upper and lower sides of the intermediate foam material body is provided with mutually crossing recesses. The lower recess is located in the middle between two upper recesses. The foam material body provided with the recesses is straight in the longitudinal direction and in the transverse direction before insertion between the two outer foam material plates, so that the originally straight recesses become V-shaped. This mattress possesses disadvantages which are similar to the disadvantages of the above-described mattresses.

SUMMARY OF THE INVENTION

Accordingly, it is an object of the present invention to provide a foam material body for a mattress and an element of furniture equipped with the same, which avoids the disadvantages of the prior art.

More particularly, it is an object of the present invention to provide a foam material body for a mattress, which, starting from its horizontal position, is highly flexible along a vertical plane extending in its longitudinal direction and is not excessively compressed at individual locations despite loading of its supporting faces.

In other words, it is an object of the present invention to provide a foam material body for a mattress which has an increased flexibility compared with the known mattresses, and in addition provides for a better adaptability to the contours of the user's body than the known mattresses.

In keeping with these objects and with others which will become apparent hereinafter, one feature of the present invention resides, briefly stated, in a foam material body with a core member which has a plurality of recesses provided in each of supporting surfaces of the core member, wherein each of the recesses has a depth which is smaller than half the width of the core member and has an initial recess portion open at a respective one of the supporting surfaces, two deeper recess portions extending inwardly from the initial portion and also away of one another so as to form a pair of lips, and two narrow recess portions each connecting the initial recess portion with a respective one of the deeper recess portions. When the foam material body for a mattress is designed in accordance with the present invention, the above-mentioned objects are attained.

As for the term "core" which is mentioned here, this term is utilized to identify a central layer which is located between two outer layers. However, in simple and particularly cost-favorable mattresses, the foam material body can be composed only of the core provided at its upper and lower supporting faces with the above-mentioned recesses.

The novel features of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
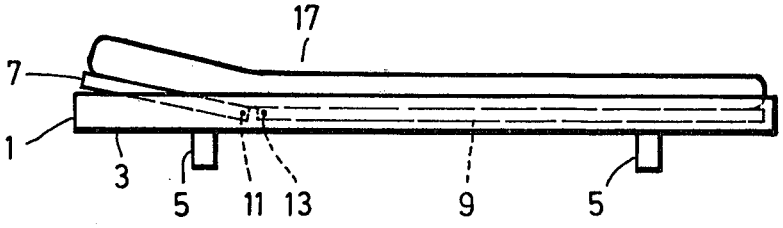
FIG. 1 is a side view of an element of furniture with a mattress in accordance with the present invention.

FIG. 1 shows an element of furniture adapted for supporting a person in a lying position. It comprises a support 1, a frame 3, and legs 5. Two batten grates 7 and 9 are supported on the frame 3 pivotally about axes 11 and 13. The axes 11 and 13 are horizontal and extend transverse to the longitudinal direction of the support 1.

Figure 2:
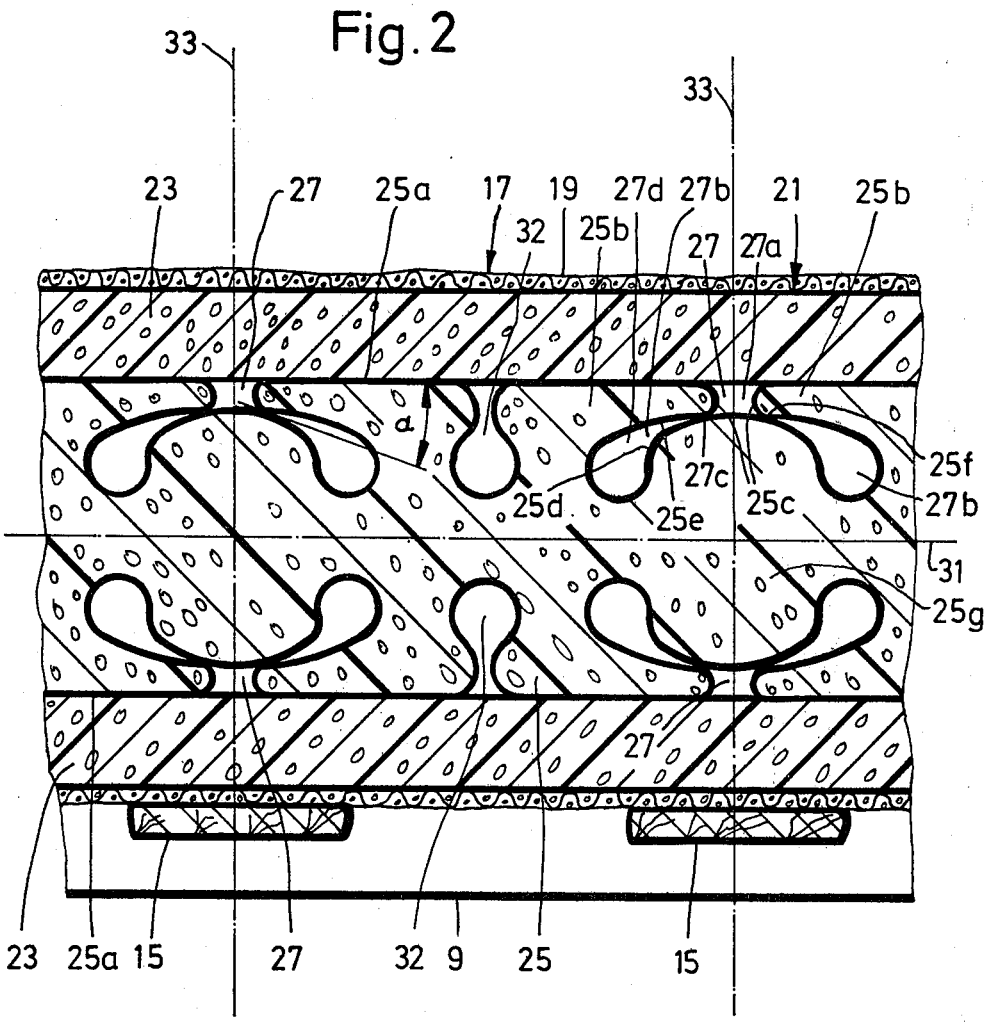
FIG. 2 is an enlarged view showing a longitudinal section of a part of a batten grate and the mattress supported on the same.

Both batten frames 7 and 9 can be fixed in different tilting positions by not shown adjustable supporting members. Each of the batten grates is provided with several spring transverse battens which extend parallel to one another in direction transverse to the direction of elongation of the support 1 and are spaced from one another by identical distances. Two of these transverse battens of the batten grate 9 are shown in FIG. 2 and identified by reference numeral 15. Both batten grates support a mattress 17.

The construction of the mattress 17 can be clearly appreciated from FIG. 2 and will now be explained in detail. The mattress has a jacket 19 which is constituted substantially of a fabric and embraces a foam material body which is identified in toto by reference numeral 21. The foam material body 21 includes three layers which in normal position are flat and extend in a horizontal direction. More particularly, these layers include two outer layers 23 and a core 25 located therebetween. The core 25 is glued with or welded to the outer layers 23 along its supporting faces.

The foam material body 21 is constituted of polyurethane or polyester. The outer layers 23 are constituted of a softer foam material than the core 25, for example of a latex foam material. Both outer layers 23 are generally formed as plates which do not have openings, passages, recesses or the like, with the exception of the pores of the foam material.

The core 25 is also substantially plate-shaped and bounded from above and from below by two supporting faces 25*a*. When the foam material body extends horizontally without deformation, the supporting faces 25*a* are parallel to one another and flat. A central axis 31 which forms a plane of symmetry and extends between both supporting faces 25*a* also extends in a horizontal plane.

The core 25 is provided in its supporting faces 25*a* with a plurality of recesses 27. The recesses 27 are straight and extend parallel to and at equal distances from one another. The recesses 27 extend in direction transverse to the direction of elongation of the foam material body. The direction of elongation of the mattress for a double layer corresponds to the general direction in which the user's body extends in lying position. The recesses 27 extending from the upper and lower supporting faces 25*a* form a plurality of pairs which in undeformed condition are symmetrical relative to the central plane 31. The whole foam material body 21 is symmetrical relative to the central plane 31. Moreover, each recess 27 in undeformed condition is symmetrical relative to its plane of symmetry 33 which extends normal to the central plane 31. The planes of symmetry 33 extend in direction of elongation of the recesses 27.

Each recess 27 has an initial recess portion 27*a* which is open at a respective one of the supporting faces 25*a*. Each initial recess portion 27*a* has an end facing toward the interior of the core 25 and branches at this end into two deeper recess portion 27*b*. Each deeper recess portion 27*b* is connected with the initial recess portion 27*a* by a narrow portion 27*c*. Each deeper recess portion 27*b* enlarges in direction away from the initial recess portion 27*a* so as to form a pear-like section 27*d*.

A pair of lips 25*b* are formed between each portion 27*b* and the supporting face 25*a* at which the latter is open. The lips 25*b* have ends 25*c* which face toward one another and bound a free intermediate space formed by the initial recess portions 27*a*. The distance between the free ends of each pair of lips is equal approximately to three millimeters and preferably is selected between five millimeters and fifteen millimeters.

The deeper recess portions 27*b* are bounded from inside, that is in the region closer to the central plane 31, by a bounding face 25*d* of the core. The bounding faces 25*d* are curved and inclined from the initial recess portions 27*a* to the deeper recess portions 27*b* in the direction toward the central plane 31. Thereby, the deepest part of the enlarged section 27*d* are located close to the central plane 31. The lips 25*b* are bounded from inside by bounding faces 25*e* which are curved from the free ends 25*c* of the lips to the roots of the latter, so that the bounding faces 25*a* approach the central plane 31. The thickness of the lips measured in direction normal to the supporting faces 25*a* thereby gradually increases toward the roots of the lips.

The recesses 27 are produced by a cutting tool as cut-outs in the supporting surfaces 25*a* of the core. In the region of the narrow recess portions 27*c*, the width of the recesses is as small as possible. In the region of the narrow recess portions 27c, the distance between the lips 25b and the bounding face 25d is relatively small and is equal, for example, substantially to between one millimeter and two millimeters. When the mattress is loaded by a person in the region of the lips 25b, the latter lie near their free ends on a portion 25f of the bounding face 25d. The above-mentioned portion 25f on which the lips 25b lie in loaded condition, is inclined relative to the supporting face 25a at an angle which is identified by the letter $\alpha$. The angle $\alpha$ which somewhat varies along the portion 25f, does not exceed 45°, and preferably is equal to 30°.

Each recess 27 extending from a respective one of the supporting faces 25a has the deepest point which is spaced from this supporting face 25a in direction normal to the latter by a distance smaller than half the height of the core 25 measured in the same direction. Preferably, this distance is equal to substantially between 30% and 40% of the height of the core. Thus, the recesses do not reach to the central axis 31.

Four deeper recess portions 27b of two recesses 27 which are symmetrical relative to the central plane 31, together form a web 25g which is constituted of foam material of the core 25. In the region of the central plane 31 the web 25g is connected with the material of the remaining portion of the core 25. The bounding faces 25d which bound the web 25g extend approximately as circular arcs toward the axis, at least in the region which is close to the plane of symmetry 33. The center of these circular arcs is formed by intersection of the central plane 31 with the planes of symmetry 33.

As can be seen from FIG. 2, the neighboring transverse battens 15 are spaced from one another by a distance which is equal to the distance between neighboring recesses 27. Thus, the mattress 17 can be so arranged on the batten frames 7 and 9 that each pair of recesses 27 are located above one transverse batten 15.

During utilization of the mattress 17, it can be bent or angled from its horizontal position along a vertical plane extending in its longitudinal direction, for example, by inclination of the batten grate 7, as can be seen from FIG. 1. The neutral fiber pertaining to this bending is located then at least near the central plane 31. In the bending positions, the lips 25b of each recess 27 provided in the upper supporting face of the core 25 displace toward one another, whereas the lips in the lower supporting surface of the core displace away from one another. The web 25g provided with arcuate upper and lower bounding faces 25d forms a kind of hinge about which the lips 25b slide. The outer layers 23 composed of a softer and easier stretchable foam material than the core, are compressed at the upper side of the foam material body 21 and stretched at the lower side of the same in bent condition.

The foam material body 21 has very good flexibility in a plane which is normal to the longitudinal direction of the recesses 27. Since the lips 25b near their free ends 25c lie on the portions 25f of the bounding faces 25d, the resistance to compression of the foam material body 21 is reduced only insignificantly, despite the pressure applied in the region of the recesses 27 normal to the supporting faces 25a, as compared with the remaining portions of the body.

As can be seen from FIG. 2, an additional recess 32 is provided between two neighboring recesses 27 in each supporting face 25a of the foam material body 21. The recesses 32 extend parallel to the recesses 27 and have a pear-shaped or drop-shaped cross-section. Each recess 32 has a mouth portion which somewhat enlarges outwardly. Such recesses are known for the foam material bodies of the mattresses, wherein they provide for increased flexibility. In the mattress in accordance with the present invention wherein the flexibility is guaranteed by the recesses 27, the additional recesses 32 are provided only in a region which starts at a distance of approximately 30 centimeters from one side and ends at a distance of approximately 60 centimeters from the same side of the foam material body. The user's shoulders are generally located in this region, and this region is softer and better deformable than the remaining part of the foam material body. Thereby, it is guaranteed that a correct depression for the shoulder is formed when the user lies on the mattress in side position.

It is understood that the outer layers 23 can be dispensed with, so that the foam material body is composed exclusively from the core 25.

It will be understood that each of the elements described above, or two or more together, may also find a useful application in other types of constructions differing from the types described above.

While the invention has been illustrated and described as embodied in a foam material body for a mattress and an element furniture provided with the latter, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A foam material body for a mattress, comprising an elongated core member having a length, a width, a thickness and two supporting surfaces spaced from one another in direction of the thickness, said core member having a plurality of recesses provided in each of said supporting surfaces, said recesses being spaced from one another in direction of the length of said core member and each extending in direction of the width of the latter, each of said recesses having an initial recess portion which is open at a respective one of said supporting surfaces and extends from the latter inwardly in direction of the thickness of said core member, two deeper recess portions spaced from said initial portion inwardly substantially in the direction of the thickness of said core member and also spaced away of one another in direction of the length of said core member and together with a respective one of said supporting faces forming a pair of lips which have ends facing toward one another and bounding a free spaced defined by said initial recess portion, and two narrow recess portions each connecting said initial recess portion with a respective one of said deeper recess portions, each of said recesses having a depth, as measured from a respective one of said supporting surfaces in direction of the thickness of said core member, which is smaller than half the thickness of said core member.

2. A foam material body for a mattress as defined in claim 1, wherein said core member has two sides extending in the direction of the width, said recesses extending parallel to one another and to said sides of said core member.

3. A foam material body for a mattress as defined in claim 1, wherein said core member has an inner part located opposite to said lips and bounding each of said recesses from inside, each of said lips being spaced from said inner part in the region of a respective one of said narrow recess portions by a distance substantially corresponding to 2 mm.

4. A foam material body for a mattress as defined in claim 3, wherein said core member has a central plane extending between said supporting surfaces, said inner part having a plurality of inner faces bounding each of said recesses from inside, each of said inner faces in the region of each of said deeper recess portions being curved in direction from said initial recess portion of each of said recesses towards said central plane of said core member.

5. A foam material body for a mattress as defined in claim 1, wherein each of said deeper recess portions has a depth increasing in direction away from said initial portion of each of said recesses.

6. A foam material body for a mattress as defined in claim 5, wherein said inner part of said core member has a plurality of inner faces bounding each of said recesses from inside, each of said inner faces having a section located in the region of one of said narrow recess portions of each of said recesses and forming with a respective one of said supporting surfaces, bounding a respective one of said lips, an angle which is at most equal to 45°.

7. A foam material body for a mattress as defined in claim 1, wherein said core member has a central plane extending between said supporting surfaces, said plurality of recesses including a first group of recesses formed in one of said supporting surfaces, and a second group of recesses formed in the other of said supporting surfaces, each of the recesses of said first group being located symmetrically with a respective one of the recesses of said second group relative to said central plane.

8. A foam material body for a mattress as defined in claim 7, each two symmetrical recesses of said groups being bounded from inside and separated from one another by a web-like section of said inner part of said core member.

9. A foam material body for a mattress as defined in claim 1, wherein each of said recesses is elongated in the direction of the width of said core member, said core member having a plurality of planes extending normal to said supporting surfaces and in direction of elongation of each of said recesses, each of said recesses being symmetrical relative to a respective one of said planes.

10. A foam material body for a mattress as defined in claim 1, wherein each of said lips has a free end section located in the region of said initial recess portion and a root section spaced from the latter in the direction of the length of said core member, each of said lips having a thickness increasing in direction from its free end section toward its root section.

11. A foam material body for a mattress as defined in claim 1, wherein said core has a plurality of additional recesses provided on said supporting surfaces and extending between said first-mentioned recesses parallel to the latter, each of said additional recesses having an initial recess section which is open at a respective one of said supporting faces and a deeper recess portion which extends inwardly from said initial recess portion and is wider than the latter.

12. A foam material body for a mattress as defined in claim 11, wherein each of said additional recesses is pear-shaped.

13. A foam material body for a mattress as defined in claim 11, wherein each of said additional recesses is drop-shaped.

14. A foam material body as defined in claim 1; and further comprising additional layers each arranged at a respective one of said supporting surfaces of said core member and connected with the same.

15. A foam material body as defined in claim 14, wherein said additional layers are glued with said supporting surfaces of said core member.

16. A foam material body as defined in claim 14, wherein said additional layers are welded with said supporting surfaces of said core member.

17. An element of furniture, comprising a support; and a mattress including an elongated core member which is constituted of foam material and has a length, a width, a thickness and two supporting surfaces spaced from one another in direction of the thickness, said core member having a plurality of recesses provided in each of said supporting surfaces, said recesses being spaced from one another in direction of the length of said core member and each extending in direction of the width of the latter, each of said recesses having an initial recess portion which is open at a respective one of said supporting surfaces and extends from the latter inwardly in direction of the thickness of said core member, two deeper recess portions spaced from said initial portion inwardly substantially in the direction of the thickness of said core member and also spaced away of one another in direction of the length of said core member and together with a respective one of said supporting faces forming a pair of lips which have ends facing toward one another and bounding a free spaced defined by said initial recess portion, and two narrow recess portions each connecting said initial recess portion with a respective one of said deeper recess portions, each of said recesses having a depth, as measured from a respective one of said supporting surfaces in direction of the thickness of said core member, which is smaller than half the thickness of said core member.

18. An element of furniture as defined in claim 17, wherein said recesses are spaced from one another in direction of elongation of said core member by predetermined distances; and further comprising a plurality of battens arranged along at least one of said supporting surfaces of said core members and spaced from one another by distances corresponding to said distances between said recesses of said core member.

19. A foam material body for a mattress, comprising an elongated core member having a length, a width, a thickness and two supporting surfaces spaced from one another in direction of the thickness, said core member having a plurality of recesses provided in each of said supporting surfaces, said recesses being spaced from one another in direction of the length of said core member and each extending in direction of the width of the latter, said core member having a central plane extending between said supporting surfaces, said recesses being arranged in pairs so that one recess of each pair is provided in one of said supporting surfaces whereas the other recess of the same pair is provided in the other of said supporting surfaces, the recesses of each pair being symmetrical to one another relative to said central plane and parallel to one another, the recesses of each pair having bounding faces facing toward said central plane and curved from a center of each recess inwardly in direction of thickness of said core member and toward said central plane, so that the bounding faces of the recesses of each pair bound therebetween a web.

20. A foam material body as defined in claim 19, wherein said recesses are elongated in direction of the width of said core member and extend over the entire width of the latter.

21. A foam material body as defined in claim 19, wherein each of said recesses has a central initial recess portion which opens at a respective one of said supporting surfaces and forms together with the latter a pair of lips in said core member.

* * * * *